US010684062B2

(12) United States Patent
Kim et al.

(10) Patent No.: US 10,684,062 B2
(45) Date of Patent: Jun. 16, 2020

(54) REFRIGERATOR

(71) Applicant: LG ELECTRONICS INC., Seoul (KR)

(72) Inventors: Minsub Kim, Seoul (KR); Hangbok Lee, Seoul (KR); Jungkyu Son, Seoul (KR); Eugene Suh, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/327,406

(22) PCT Filed: Nov. 6, 2015

(86) PCT No.: PCT/KR2015/011928
§ 371 (c)(1),
(2) Date: Jan. 19, 2017

(87) PCT Pub. No.: WO2016/072796
PCT Pub. Date: May 12, 2016

(65) Prior Publication Data
US 2017/0254583 A1 Sep. 7, 2017

(30) Foreign Application Priority Data
Nov. 7, 2014 (KR) ..... 10-2014-0154466

(51) Int. Cl.
*F25D 23/02* (2006.01)
*E05C 19/16* (2006.01)
*F25D 25/02* (2006.01)

(52) U.S. Cl.
CPC ..... *F25D 23/028* (2013.01); *E05C 19/161* (2013.01); *F25D 23/02* (2013.01); *F25D 25/025* (2013.01); *F25D 2323/021* (2013.01)

(58) Field of Classification Search
CPC ..... F25D 23/02; F25D 23/028; F25D 25/025; E05C 19/161
(Continued)

(56) References Cited

U.S. PATENT DOCUMENTS 7,726,756 B2 6/2010 Fu
2005/0046319 A1* 3/2005 Chekal ..... F25D 11/02 312/401
(Continued)

FOREIGN PATENT DOCUMENTS

CN 1103038 3/2003
CN 102353220 2/2012
(Continued)

OTHER PUBLICATIONS

International Search Report in International Application No. PCT/KR2015/011928, dated Feb. 17, 2016, 10 pages (with English translation).
(Continued)

*Primary Examiner* — James O Hansen
(74) *Attorney, Agent, or Firm* — Fish & Richardson P.C.

(57) ABSTRACT

A refrigerator is disclosed. The refrigerator includes a cabinet provided with a storage compartment, an inner case to define an appearance of the storage compartment, a first door (20) pivotally mounted to the cabinet, to open or close one side of the storage compartment, and a second door (40) pivotally mounted to the cabinet, to open or close the other side of the storage compartment. The second door (40) is provided with a pillar (100) rotatable to come into contact with the first door (20). The pillar (100) is spaced apart from a top wall of the inner case and a bottom wall of the inner case, to be prevented from coming into contact with the inner case when the second door (40) is maintained to seal the storage compartment.

17 Claims, 8 Drawing Sheets

(58) Field of Classification Search
USPC ..... 312/401, 405, 405.1, 404, 296
See application file for complete search history.

(56) References Cited

U.S. PATENT DOCUMENTS

| | | | | |
|---|---|---|---|---|
| 2007/0138925 | A1* | 6/2007 | Fu | F25D 23/069 312/401 |
| 2012/0073321 | A1 | 3/2012 | Davis et al. | |
| 2013/0241385 | A1* | 9/2013 | Lee | F25D 23/028 312/404 |
| 2014/0375198 | A1* | 12/2014 | Jeon | F25D 23/028 312/404 |

FOREIGN PATENT DOCUMENTS

| | | |
|---|---|---|
| EP | 2762814 | 8/2014 |
| JP | H08-0170871 | 7/1996 |
| JP | 20070024405 | 2/2007 |
| KR | 10-0201025 | 6/1999 |
| KR | 10-2006007515 | 7/2006 |
| KR | 1020060075396 | 7/2006 |

OTHER PUBLICATIONS

Chinese Office Action in Chinese Application No. 201580035181.4, dated Jul. 3, 2018, 13 pages.
Extended European Search Report in European Application No. 15857197.6, dated Nov. 22, 2017, 7 pages (with English translation).

* cited by examiner

[Fig. 1]
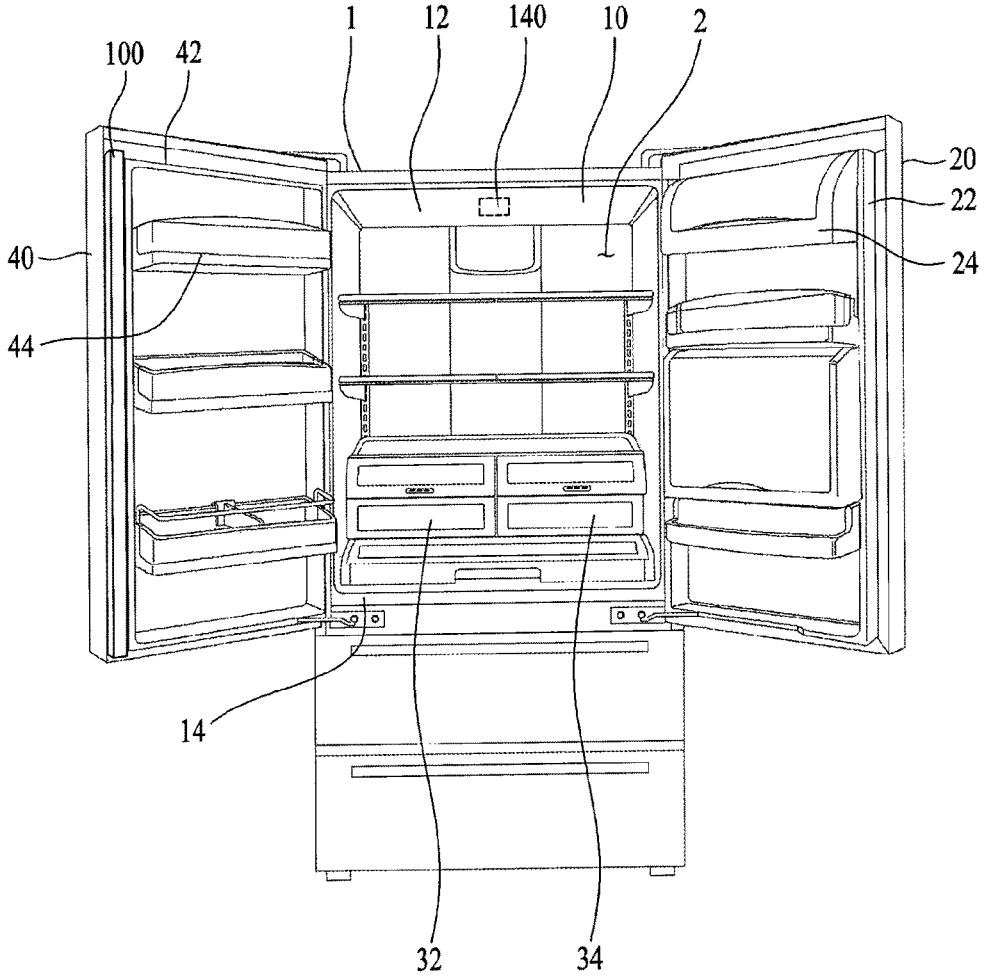

[Fig. 2]
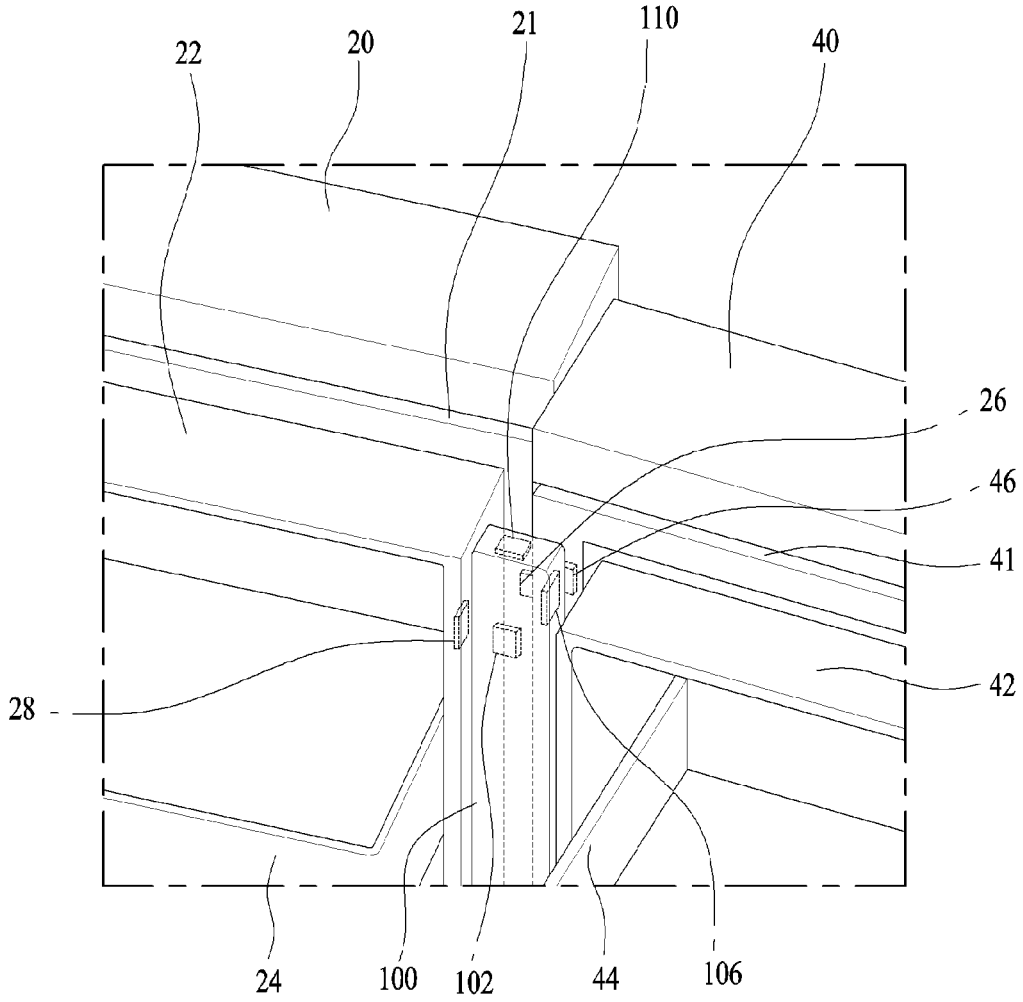

[Fig. 3]
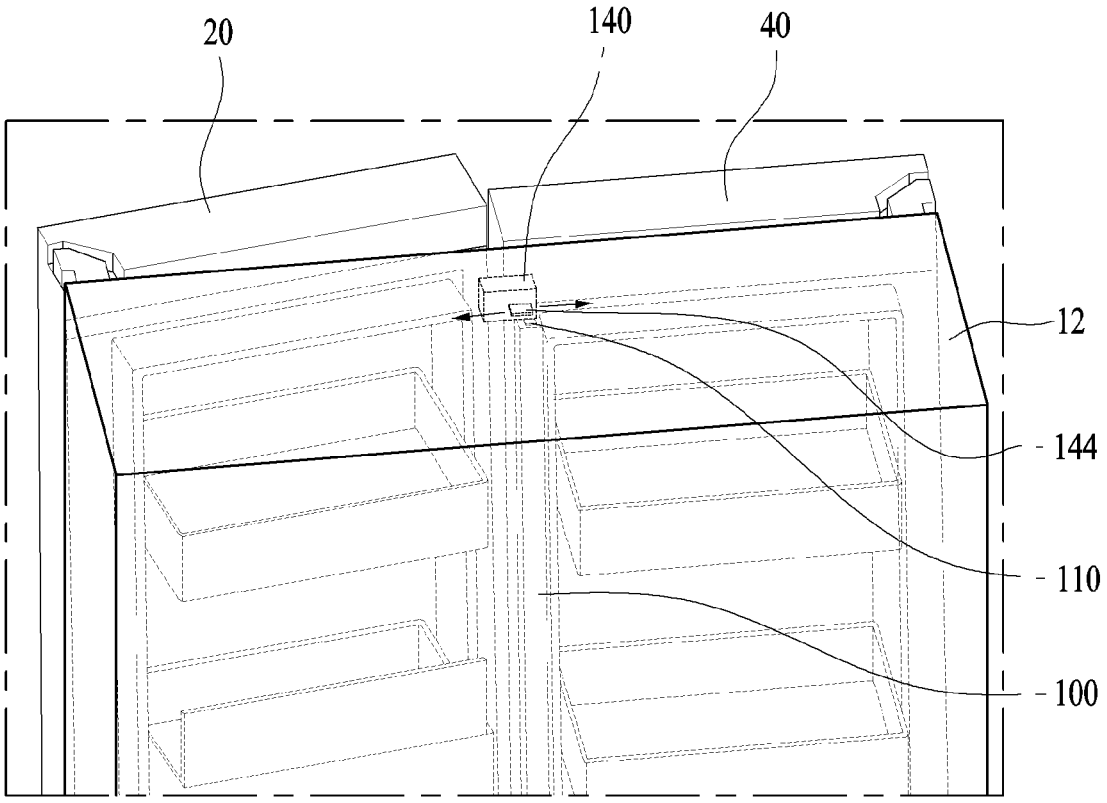

[Fig. 4]
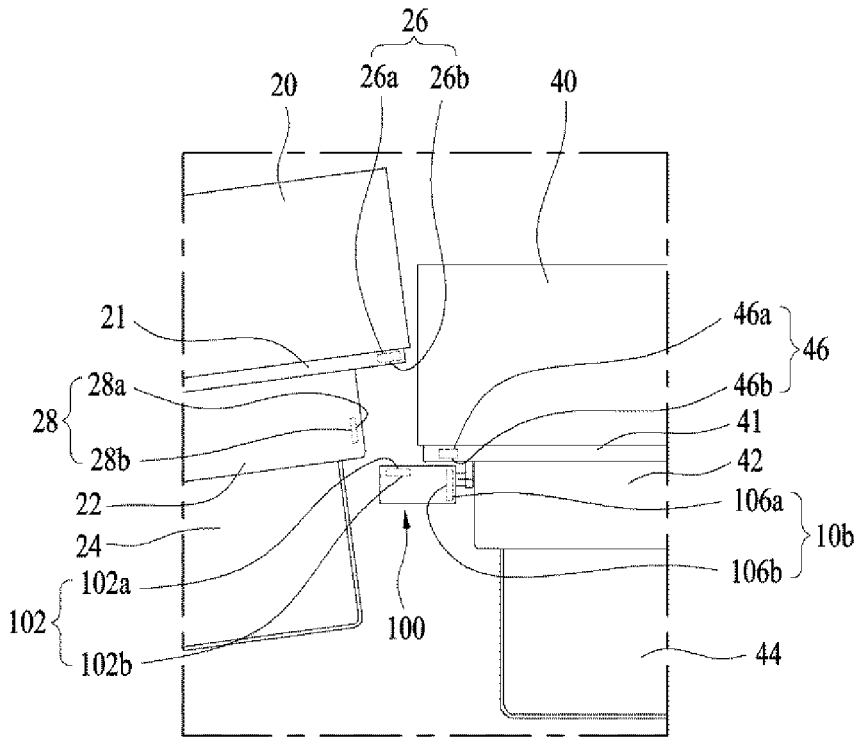
(a)
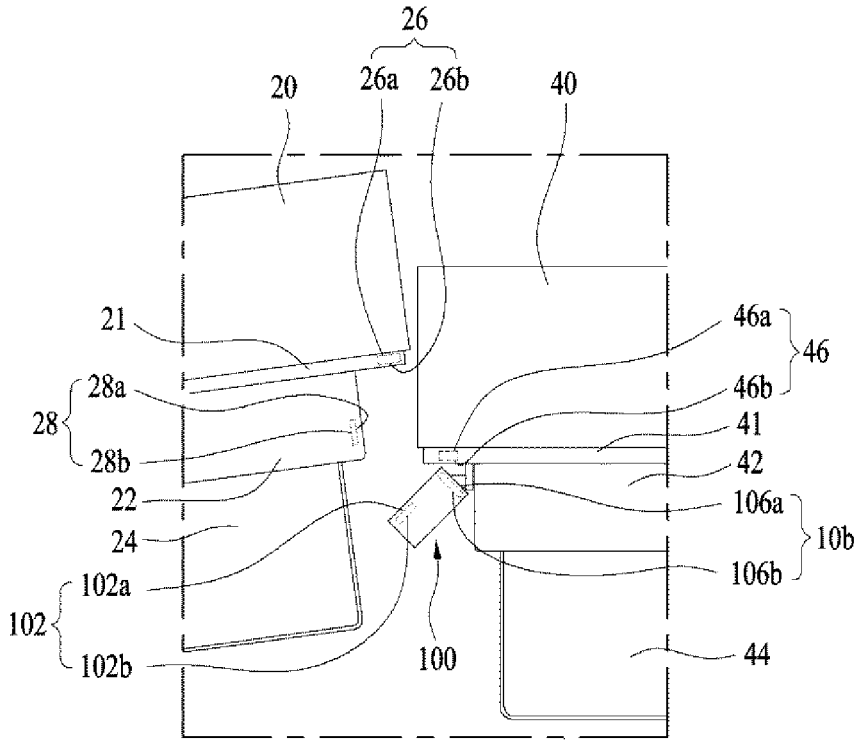
(b)

[Fig. 5]
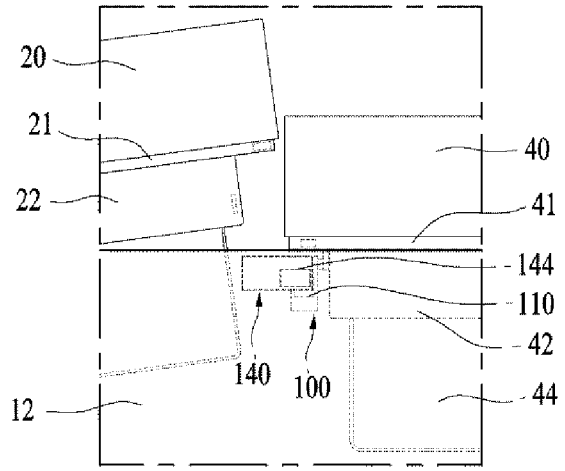
(a)
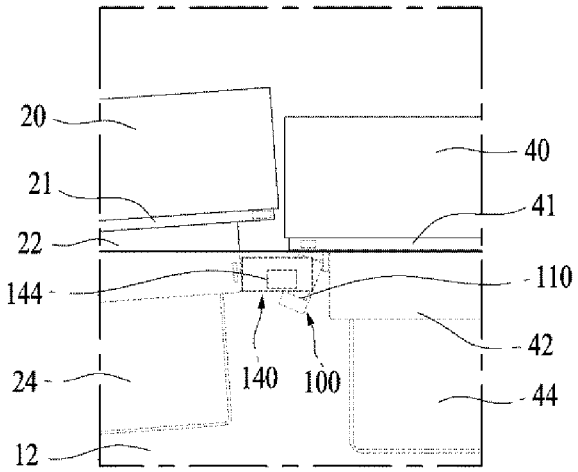
(b)
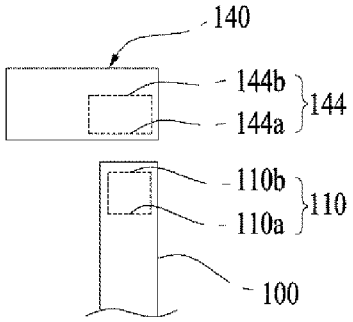
(c)

[Fig. 6]
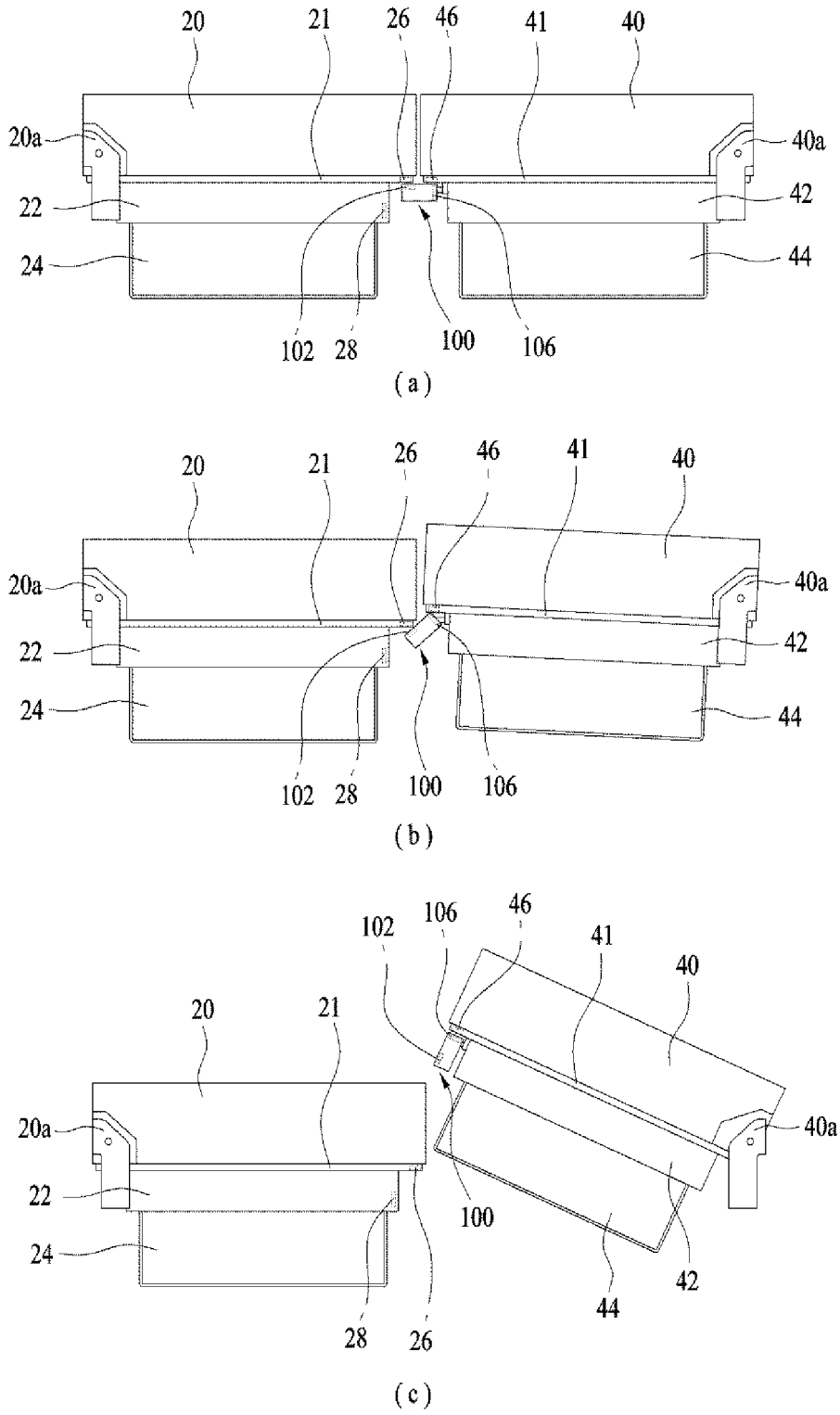

[Fig. 7]
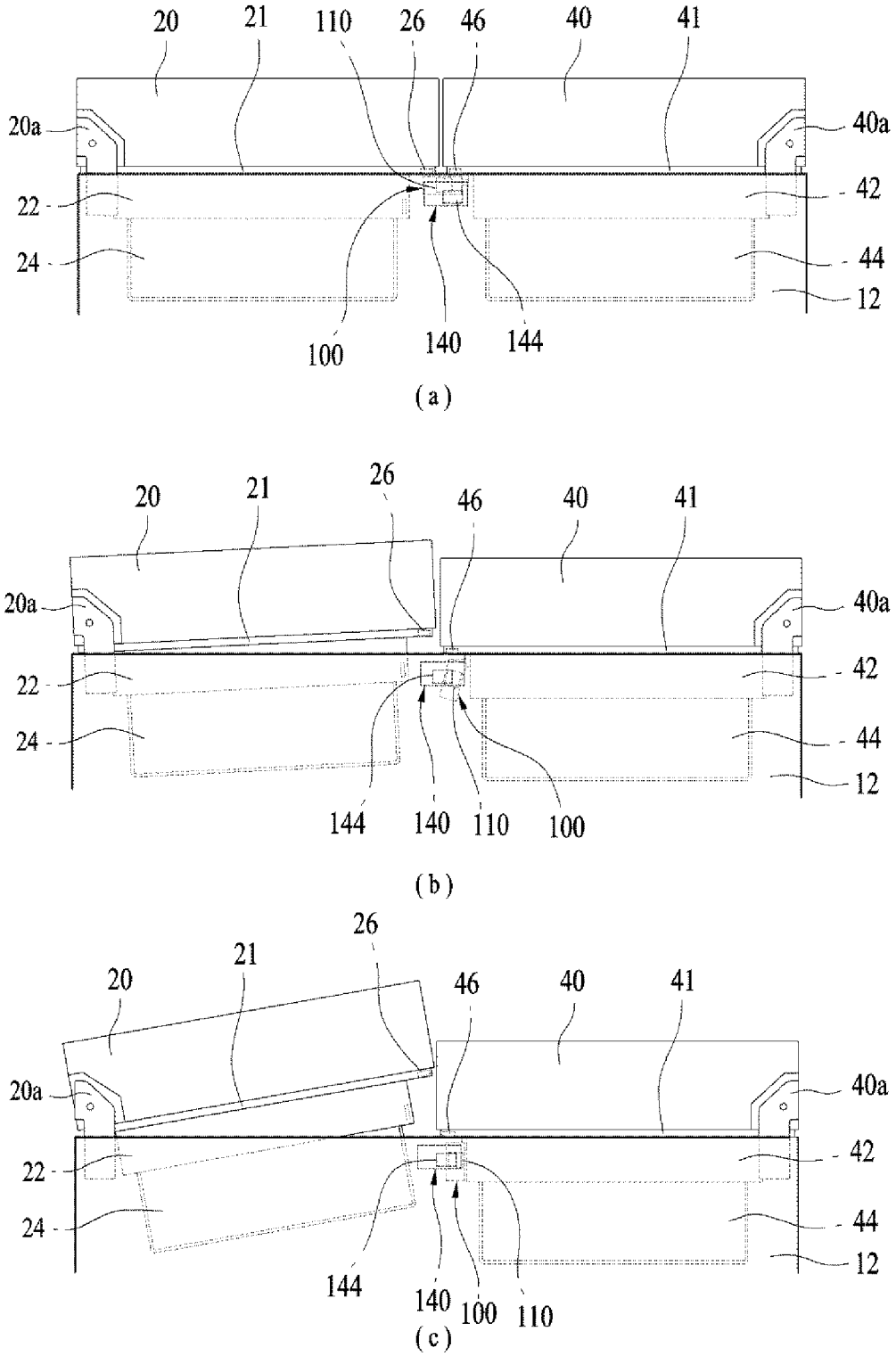

[Fig. 8]
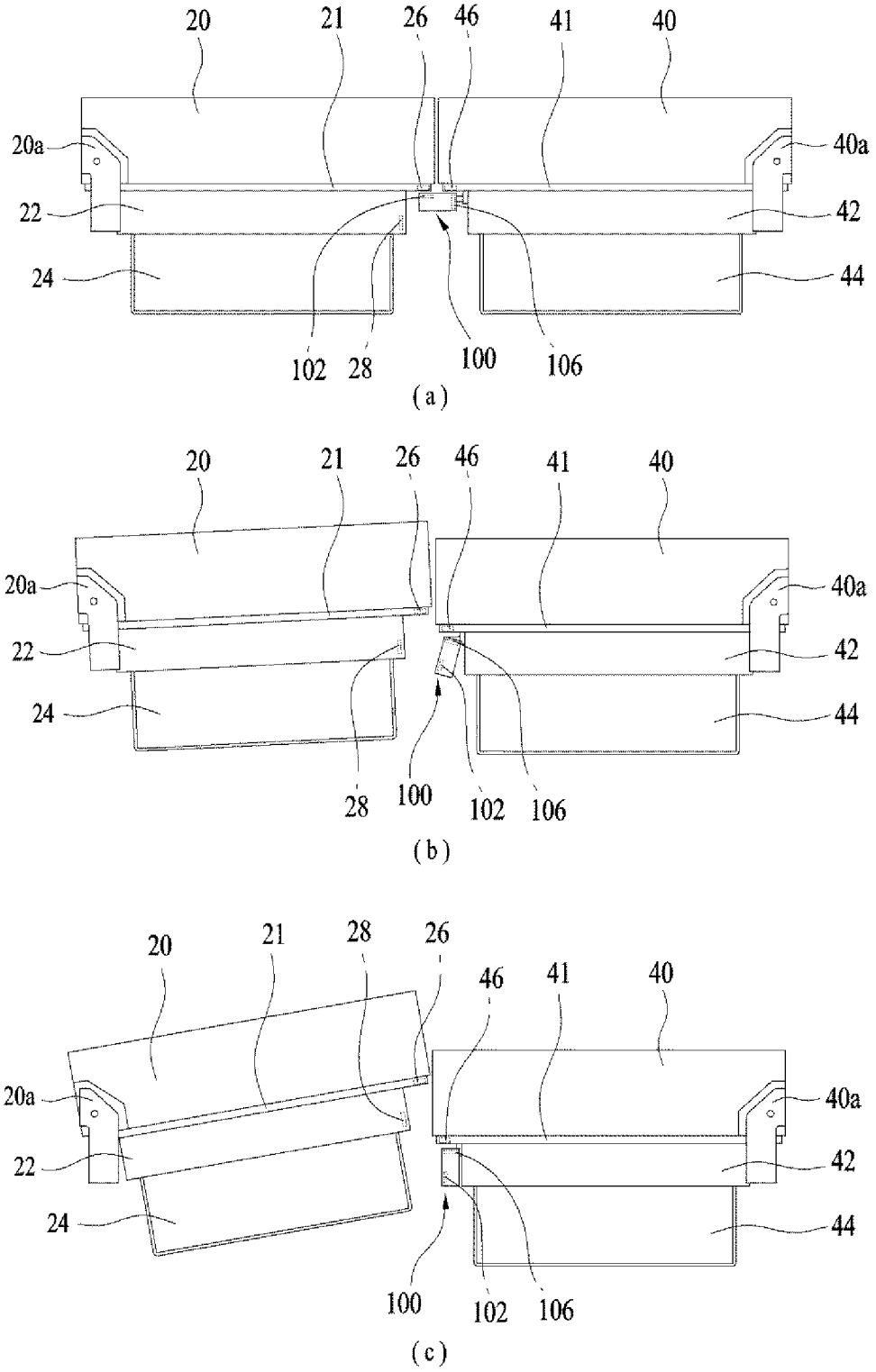

REFRIGERATOR

CROSS REFERENCE TO RELATED APPLICATIONS

This application is a U.S. National Phase Application under 35 U.S.C. § 371 of International Application PCT/KR2015/011928, filed on Nov. 6, 2015, which claims the benefit of Korean Application No. 10-2014-0154466, filed on Nov. 7, 2014, the entire contents of which are hereby incorporated by reference in their entireties.

TECHNICAL FIELD

The present invention relates to a refrigerator, and more particularly to a refrigerator having two side-by-side type doors to open one storage compartment, thereby being capable of achieving an improvement in use convenience.

BACKGROUND ART

Generally, a refrigerator is an appliance for storing food in a fresh state within a storage compartment (freezing compartment or refrigerating compartment) for a certain period of time by cooling the storage compartment through repeated operation of a refrigeration cycle.

Such a refrigerator includes a compressor for compressing refrigerant circulating through a refrigeration cycle into a high-temperature and high-pressure state. The refrigerant compressed in the compressor generates cold air while passing through a heat exchanger, and the generated cold air is supplied to a freezing compartment or a refrigerating compartment.

Generally, the refrigerator has an arrangement in which the freezing compartment is arranged at the upper side, and the refrigerating compartment is arranged at the lower side. On the other hand, in a side-by-side type refrigerator, the freezing and refrigerating compartments thereof are arranged to laterally neighbor to each other.

In a refrigerator of another type, a storage compartment provided at the upper or lower side of the refrigerator can be opened by two side-by-side type doors.

In the case in which one storage compartment can be opened by two side-by-side type doors, a pillar is provided at one of the two doors. The pillar, which is provided at only one of the two doors, comes into contact with the two doors through rotation thereof when the storage compartment is closed by the two doors and, as such, functions to enhance sealability of the storage compartment.

In a conventional refrigerator provided with such a pillar, typically, a structure including a protrusion and a guide groove is provided at an inner case of the refrigerator in order to guide rotation of the pillar.

In conventional cases, the structure to guide rotation of the pillar is formed at an upper portion of the inner case, to extend downwards. For this reason, there is inconvenience in using the storage compartment by the user.

Furthermore, in a state in which the door provided with the pillar seals a corresponding portion of the storage compartment, the pillar obstructs a path, along which a drawer installed in the refrigerator moves, because the pillar is in a state of being unfolded while escaping from the corresponding door. For this reason, there is a problem in that, when two drawers are arranged in parallel, the drawers should have different widths.

Furthermore, since the pillar is in an unfolded state as mentioned above, baskets provided at the doors should have smoothly curved corners in order to prevent the baskets from coming into contact with the pillar during rotation thereof together with the doors. For this reason, there is a problem in that the storage capacity of each basket is reduced.

DISCLOSURE OF INVENTION

Technical Problem

The present invention has been made in view of the above-mentioned problems, and an object of the present invention is to provide a refrigerator having two side-by-side type doors to open one storage compartment, thereby being capable of achieving an improvement in use convenience.

Solution to Problem

The object of the present invention can be achieved by providing a refrigerator including a cabinet provided with a storage compartment, an inner case to define an appearance of the storage compartment, a first door pivotally mounted to the cabinet, to open or close one side of the storage compartment, and a second door pivotally mounted to the cabinet, to open or close the other side of the storage compartment, wherein the second door is provided with a pillar rotatable to come into contact with the first door, wherein the pillar is spaced apart from a top wall of the inner case and a bottom wall of the inner case, to be prevented from coming into contact with the inner case when the second door is maintained to seal the storage compartment.

Advantageous Effects of Invention

In accordance with the present invention, the structure for rotating the pillar does not protrude into the storage compartment and, as such, the capacity of the storage compartment may be increased. In addition, inconvenience of the user caused by a protruding structure may be eliminated.

In addition, the pillar is in a folded state under the condition that the door provided with the pillar seals the storage compartment, and the other door opens the storage compartment. Accordingly, when the drawer installed at the side of the other door is withdrawn, the drawer is not caught on the pillar. In this regard, it may be possible to install a pair of drawers having the same width at respective sides of the doors.

Meanwhile, since the pillar is in a folded state under the condition that the door provided with the pillar seals the storage compartment, and the other door opens the storage compartment, the basket installed at the other door is not caught on the pillar when the other door rotates. Accordingly, the basket may have angled corners and, as such, may have an increased storage capacity.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a front view of a refrigerator according to an embodiment of the present invention;

FIG. 2 is a view explaining a region where magnetic members are installed in accordance with an embodiment of the present invention;

FIG. 3 is a view illustrating another region not illustrated in FIG. 2;

FIG. 4 is a view explaining polarities of magnetic members installed at the doors and pillar;

FIG. 5 is a view explaining polarities of the magnetic members installed at the pillar and drive assembly;

FIG. 6 is a view explaining an operation in which a second door rotates to open the storage compartment, which has been sealed by first and second doors;

FIG. 7 is a view explaining an operation in which the first door rotates to open the storage compartment, which has been sealed by the first and second doors; and FIG. 8 is a view illustrating a state in which the drive assembly is omitted from the configuration of FIG. 7.

BEST MODE FOR CARRYING OUT THE INVENTION

Reference will now be made in detail to the preferred embodiments of the present invention, examples of which are illustrated in the accompanying drawings.

During the process, sizes and shapes of constituent elements or the like illustrated in the drawings may be exaggerated for clarity and convenience of explanation. Further, the following terminologies are defined in consideration of the functions in the present invention and may be construed in different ways by intention or practice of users and operators. Therefore, the definitions of terms used in the present description should be construed based on the contents throughout the specification.

FIG. 1 is a front view of a refrigerator according to an embodiment of the present invention.

Referring to FIG. 1, the refrigerator according to the illustrated embodiment includes a cabinet 1 defining an appearance of the refrigerator.

The cabinet 1 is provided with a storage compartment 2 for storing food.

The storage compartment 2 may be defined by an inner case 10 provided at an inside of the cabinet 1. The inner case 10 may include a top wall 12 and a bottom wall 14 in order to define an inner surface of the storage compartment 2. The storage compartment 2 is open at a front side thereof and, as such, the user may access the storage compartment 2 through the front side of the storage compartment 2.

The cabinet 1 is provided, at a front side thereof, with a first door 20 pivotally mounted to the cabinet 1, to open or close one side of the storage compartment 2, and a second door 40 pivotally mounted to the cabinet 1, to open or close the other side of the storage compartment 2. When the first door 20 and second door 40 close the front side of the storage compartment 2, the storage compartment 2 may be completely sealed.

The second door 40 may be provided with a pillar 100 rotatable to come into contact with the first door 20. The pillar 100 generally has a rectangular parallelepiped shape. The pillar 100 is coupled to the second door 40 such that the pillar 100 is rotatable with respect to the second door 40. In this case, the pillar 100 may be arranged to have different rotation angles with respect to the second door 40 in accordance with rotation angles of the second door 40 with respect to the storage compartment 2 or whether the first door 20 opens or closes the storage compartment 2.

The pillar 100 has a shorter length than the distance between the top wall 12 and the bottom wall 14 in the inner case 10 in order to prevent the pillar 100 from contacting the top wall 12 and bottom wall 14. That is, although the second door 40 rotates to close the storage compartment 2, the pillar 100 does not contact any of the top wall 12 and bottom wall 14. There is no element arranged at the structure of the inner case 10, namely, the top wall 12 and bottom wall 14, to limit rotation of the pillar 100 and, as such, the top wall 12 and bottom wall 14 may generally form one plane.

The first door 20 may be provided with a door dike 22 defining a rear appearance of the first door 20. Similarly, the second door 40 may be provided with a door dike 42 defining a rear appearance of the second door 40.

Baskets 24 and 44 may be mounted to the door dikes 22 and 42, to store various food articles. The basket 24, which is provided at the first door 20, at which the pillar 100 is not provided, does not interfere with the pillar 100 when the first door 20 rotates. In this regard, the basket 24 may have angled corners. In this case, accordingly, it may be possible to store an increased amount of food in the basket 24, as compared to a basket having round corners.

The storage compartment 2 may be provided with a first drawer 34 arranged at the side of the first door 20, and a second drawer 32 arranged at the side of the second door 40. In this case, the first drawer 34 and second drawer 32 may be flush with each other. That is, the first drawer 34 and second drawer 32 may be arranged at the same level at left and right sides in the storage compartment 2, respectively. The first drawer 34 and second drawer 32 may be independently withdrawn.

The first drawer 34 and second drawer 32 may have the same width. That is, the first drawer 34 and second drawer 32 may have the same storage capacity and, as such, are interchangeable. If the first drawer 34 and second drawer 32 have different widths and, as such, have different shapes, manufacturing costs thereof may be increased because it is necessary to manufacture two kinds of drawers. On the other hand, when the first drawer 34 and second drawer 32 have the same shape, as described above, there is an advantage in that manufacturing costs may be reduced.

In the illustrated embodiment of the present invention, it may be possible to open the first door 20 and to withdraw the first drawer 34 under the condition that the second door 40 seals a corresponding portion of the storage compartment 2. This effect may be achieved because the pillar 100 is not arranged on a path, along which the first drawer 34 is withdrawn. This will be described later with reference to the accompanying drawings.

Meanwhile, in an embodiment of the present invention, the first door 20 and second door 40 may have the same width. Accordingly, the processes for manufacturing the first door 20 and second door 40 may be partially duplicated and, as such, manufacturing costs of the first door 20 and second door 40 may be reduced. This will be described later with reference to the remaining ones of the accompanying drawings.

A drive assembly 140 may be provided at an inside of the top wall 12 in the inner case 10, to rotate the pillar 100 under particular conditions. The drive assembly 140 is arranged to be movable in forward and rearward directions.

In an embodiment of the present invention, the pillar 100 may be rotated without using a physical element such as a guide protrusion, but using magnetic force. In this regard, the drive assembly 140 may be embedded in the top wall 12, to be hidden from the user.

Accordingly, the portion of the top wall 12 where the drive assembly 140 is installed may have the same level as other portions of the top wall 12 adjacent thereto. That is, the portion of the top wall 12 where the drive assembly 140 is installed is flush with the adjacent portions of the top wall 12 and, as such, the user cannot find whether or not the drive assembly 140 is installed at the inside of the top wall 12. In this regard, it may be possible to eliminate inconvenience of the user caused by protrusion of the top wall portion where the drive assembly 140 is installed or other problems, for example, reduction of storage capacity.

FIG. 2 is a view explaining a region where magnetic members are installed in accordance with an embodiment of the present invention.

Referring to FIG. 2, gaskets 21 and 41 are installed at rear sides of the first and second doors 20 and 40, respectively. The gaskets 21 and 42 are made of a rubber material and, as such, may seal the storage compartment 2 while contacting an opening formed at the front side of the storage compartment 2.

The door dikes 22 and 42 may be arranged at rear sides of the gaskets 21 and 41, respectively, to define rear appearances of the first and second doors 20 and 40. As described above, the baskets 24 and 44 may be provided at the door dikes 22 and 42, respectively.

The first door 20 may be provided with a first door magnetic member 26 having magnetic force, and a door dike magnetic member 28 having magnetic force. A second door magnetic member 46 having magnetic force may be provided at the second door 40.

The pillar 100 may be provided with a first pillar magnetic member 102 to magnetically interfere with the first door magnetic member 26, and a second pillar magnetic member 106 to magnetically interfere with the second door magnetic member 46. In this case, the first pillar magnetic member 102 may magnetically interfere with not only the first door magnetic member 26, but also the door dike magnetic member 28.

In an embodiment of the present invention, each magnetic member may mean a magnet having N and S poles.

Each of the first door magnetic member 26, second door magnetic member 46, first pillar magnetic member 102, second pillar magnetic member 106, and door dike magnetic member 28 may have a rectangular parallelepiped shape having a wider cross-section at one side than at the other side.

The first door magnetic member 26 may be installed at the gasket 21 of the first door 20, whereas the door dike magnetic member 28 may be installed at the door dike 22 provided at a rear side of the first door 20. In addition, the second door magnetic member 46 may be installed at the gasket 41 of the second door 40.

The door dike magnetic member 28 may be arranged inwards of the storage compartment 2, as compared to the second door magnetic member 46.

The first pillar magnetic member 102 and second pillar magnetic member 106 may be arranged to be perpendicular to corresponding surfaces of the pillar 100, which generally has a rectangular cross-sectional shape, respectively. The first and second pillar magnetic members 102 and 106 are installed at the pillar 100 and, as such, rotate together with the pillar 100 when the pillar 100 rotates.

A third pillar magnetic member 110, which may magnetically interfere with the drive assembly 140, is provided at an upper portion of the pillar 100. In this case, the third pillar magnetic member 110 may have a rectangular parallelepiped structure having a relatively greater area towards an upper portion thereof.

The first pillar magnetic member 102, second pillar magnetic member 106, and third pillar magnetic member 110 are arranged to be perpendicular to one another while being close to corresponding ones of the surfaces of the pillar 100, respectively, to achieve easy magnetic interference with one another under the condition that the first pillar magnetic member 102, second pillar magnetic member 106, and third pillar magnetic member 110 are arranged at positions where magnetic interference between corresponding ones thereof may be generated.

Meanwhile, the pillar 100 is rotatably mounted to the second door 40 and, as such, may selectively come into contact with the gaskets 21 and 41 respectively provided at the first and second doors 20 and 40.

FIG. 3 is a view illustrating another region not illustrated in FIG. 2.

Referring to FIG. 3, the drive assembly 140 may be installed to be embedded in the top wall 12 of the inner case 10. A drive magnetic member 144 capable of generating magnetic force is installed at the drive assembly 140.

In this case, the drive magnetic member 144 may magnetically interfere with the third pillar magnetic member 110 and, as such, may rotate the pillar 100 when the pillar 100 satisfies desired conditions.

The drive magnetic member 144 may move in a lateral direction of the storage compartment 2. That is, the pillar 100 may be rotated in accordance with variation of the lateral position of the drive magnetic member 144.

The drive magnetic member 144 may be moved within the drive assembly 140 in accordance with spring force applied thereto from a spring or magnetic force applied thereto from another magnetic member.

Meanwhile, since the drive assembly 140 is installed without being exposed to the outside of the top wall 12 or protruded from the top wall 12, the drive assembly 140 does not physically limit rotation of the pillar 100. Accordingly, the portion of the top wall 12 in the inner case 10 where the drive assembly 140 is installed may be flush with other portions of the top wall 12 adjacent thereto.

That is, rotation of the pillar 100 may be determined by magnetic interference between the drive assembly 140 and the pillar 100.

Meanwhile, in order to prevent rotation of the pillar 100 from being physically limited under the condition that the second door 40 is maintained to seal the storage compartment 2, the pillar 100 does not contact the top wall 12 of the inner case 10 and the bottom wall 14 of the inner case 10. To this end, the pillar 100 is spaced apart from the top wall 12 and bottom wall 14.

FIG. 4 is a view explaining polarities of magnetic members installed at the doors and pillar. In detail, FIGS. 4(*a*) and 4(*b*) illustrate a procedure in which magnetic interference is generated between corresponding ones of the magnetic members in accordance with relative positions of the first and second doors.

Referring to FIG. 4, the first door magnetic member 26 includes a first surface 26*a* exhibiting a particular polarity, and a second surface 26*b* exhibiting opposite polarity to the first surface 26*a*. In this case, the particular polarity may be one of N and S polarities. The first and second surfaces 26*a* and 26*b* are arranged opposite each other.

In the following description, first surfaces of the magnetic members may exhibit the same polarity, whereas second surfaces of the magnetic members may exhibit the same polarity, in order to generate attraction between particular ones of the magnetic members, and repulsion between other particular ones of the magnetic members.

Similarly, the second door magnetic member 46 includes a first surface 46*a* exhibiting a particular polarity, and a second surface 46*b* exhibiting opposite polarity to the first surface 46*a*.

The first pillar magnetic member 102, which magnetically interferes with the first door magnetic member 26, also includes a first surface 102*a* exhibiting a particular polarity, and a second surface 102*b* exhibiting opposite polarity to the first surface 102*a*.

The second pillar magnetic member 106, which magnetically interferes with the second door magnetic member 46, also includes a first surface 106*a* exhibiting a particular polarity, and a second surface 106*b* exhibiting opposite polarity to the first surface 106*a*.

In this case, the first surfaces 26*a* and 102*a* of the first door magnetic member 26 and first pillar magnetic member 102 may have the same polarity such that attraction is generated between the first door magnetic member 26 and first pillar magnetic member 102.

Meanwhile, the first surfaces 46*a* and 106*a* of the second door magnetic member 46 and second pillar magnetic member 106 may have the same polarity such that attraction is generated between the second door magnetic member 46 and the second pillar magnetic member 106 in a state in which the pillar 100 rotates a predetermined angle (state of FIG. 4(*b*)).

For reference, as illustrated in FIG. 4(*b*), the pillar 100 may rotate from a state of FIG. 4(*a*) in a counterclockwise direction up to an angle, at which the pillar 100 is perpendicular to the state of FIG. 4(*a*). That is, the pillar 100 is mounted to the second door 40 such that the pillar 100 rotates within a predetermined angle range.

The door dike magnetic member 28 includes a first surface 28*a* exhibiting a particular polarity, and a second surface 28*b* exhibiting opposite polarity to the first surface 28*a*, for magnetic interference thereof with the first pillar magnetic member 102. In this case, the door dike magnetic member 28 may be arranged such that repulsion is generated between the door dike magnetic member 28 and the first pillar magnetic member 102 in a state of FIG. 4(*b*).

FIG. 5 is a view explaining polarities of the magnetic members installed at the pillar and drive assembly.

FIGS. 5(*a*) and 5(*b*) are views illustrating a procedure in which the pillar rotates in accordance with movement of the drive magnetic member. FIG. 5(*c*) is a side view corresponding to FIG. 5(*a*).

Referring to FIG. 5(*c*), the drive assembly 140 is arranged over the pillar 100. In this case, the drive assembly 140 is embedded in the first inner case 10, to be hidden from the user. For convenience of explanation, several elements are omitted from FIG. 5(*c*).

As described above, the drive assembly 140 is provided with the drive magnetic member 144. The drive magnetic member 144 includes a first surface 144*a* exhibiting a particular polarity, and a second surface 144*b* exhibiting opposite polarity to the first surface 144*a*.

The third pillar magnetic member 110 includes a first surface 110*a* exhibiting a particular polarity, and a second surface 110*b* exhibiting opposite polarity to the first surface 110*a*.

In this case, the drive magnetic member 144 and third pillar magnetic member 110 may be arranged such that attraction is generated therebetween. To this end, the first surfaces 110*a* and 144*a* may have the same polarity, and the second surfaces 110*b* and 144*b* may have the same polarity.

Referring to FIGS. 5(*a*) and 5(*b*), the drive magnetic member 144 may be arranged to be laterally movable within the drive assembly 140. That is, an elastic member may be provided at each side or one side of the drive magnetic member 144, to restrain movement of the drive magnetic member 144. Alternatively, two separate magnets may be provided at the drive magnetic member 144, to restrain lateral movement of the drive magnetic member 144.

When the drive magnetic member 144 moves from a position of FIG. 5(*a*) to a position of FIG. 5(*b*), the pillar 100 is rotated from a position of FIG. 5(*a*) in a clockwise direction. As a result, one surface of the pillar 100 comes into contact with the gasket of the first door 20 and, as such, may seal the storage compartment 2.

FIG. 6 is a view explaining an operation in which the second door rotates to open the storage compartment, which has been sealed by the first and second doors.

The first door 20 may rotate about a first rotation axis 20*a*, and the second door 40 may rotate about a second rotation axis 40*a*.

In a state of FIG. 6(*a*), the first door 20 and second door 40 seal the storage compartment 2.

When the user rotates the second door 40, the pillar 100 is rotated while contacting the first door 20. When the pillar 100 is in an unfolded state with respect to the second door 40, the pillar 100 comes into contact with the first door 20 during rotation of the second door 40. In this case, during rotation of the second door 40, the pillar 100 is rotated by rotational force of the second door 40 and, as such, is folded toward the second door 40 (cf. FIG. 6(*b*)).

As the rotation angle of the second door 40 increases, the rotation angle of the pillar 100 is increased. Consequently, the pillar 100 may be rotated to be perpendicular to the front surface of the second door 40, as illustrated in FIG. 6(*c*).

Since the pillar 100 is completely folded when the second door 40 rotates, rotation of the second door 40 to open the storage compartment 2 may be achieved without any interference even when the first door 20 is maintained to seal the storage compartment 2.

Meanwhile, in accordance with operations corresponding to the order of FIG. 6(*c*), FIG. 6(*b*), and FIG. 6(*a*), the second door 40 may rotate to seal the storage compartment 2 under the condition that the first door 20 is maintained to seal the storage compartment 2, and the second door 40 has rotated to open the storage compartment 2.

Under the condition that both the first door 20 and the second door 40 seal the storage compartment 2, the pillar 100 should be rotated to be unfolded with respect to the second door 40, namely, to be parallel to the front surface of the second door 40. This is because the pillar 100 contacts not only the first door 20, but also the second door 40, in an unfolded state thereof and, as such, the storage compartment 2 may be substantially sealed.

Under the condition that the first door 20 is maintained to seal the storage compartment 2, the user may rotate the second door 40, to seal the storage compartment 2 by the second door 40, as illustrated in FIG. 6(*c*).

In this case, when the second door 40 reaches the state of FIG. 6(*b*), the pillar 100 may be rotated in a counterclockwise direction in accordance with attraction generated between the first surface 102*a* of the first pillar magnetic member 102 in the pillar 100 and the second surface 102*b* of the first door magnetic member 26. That is, although the pillar 100 does not contact the first door 20 during closing of the second door 40, the pillar 100 may be rotated from a folded state to an unfolded state by virtue of attraction between two magnets.

Meanwhile, when the second door 40 further rotates from the state of FIG. 6(*b*) in a direction that the storage compartment 2 is sealed, the pillar 100 is further rotated in the counterclockwise direction because the distance between the first pillar magnetic member 102 and the first door magnetic member 26 is reduced. As a result, the pillar 100 substantially reaches the state of FIG. 6(*a*).

That is, although the pillar 100 does not physically come into contact with an upper or lower portion of the inner case, the pillar 100 may be rotated in accordance with relative positions of the first door 20 and second door 40.

In the illustrated embodiment, in a state in which the second door 40 does not seal the storage compartment 2, the pillar 100 may be folded toward the second door 40 by magnetic force. On the other hand, in a state in which the second door 40 seals the storage compartment 2, together with the first door 20, the pillar 100 is unfolded to contact both the first door 20 and the second door 40 and, as such, the storage compartment 2 is substantially sealed.

FIG. 7 is a view explaining an operation in which the first door rotates to open the storage compartment, which has been sealed by the first and second doors. FIG. 8 is a view illustrating a state in which the drive assembly is omitted from the configuration of FIG. 7.

In operations according to the order of FIGS. 7(*a*), 7(*b*) and 7(*c*) or FIGS. 8(*a*), 8(*b*) and 8(*c*), only the first door 20 is rotated to open the storage compartment 2 under the condition that the second door 40 is maintained to seal the storage compartment 2.

First, as illustrated in FIG. 7(*a*) or 8(*a*), the pillar 100 is in an unfolded state under the condition that the first door 20 and second door 40 are maintained to seal the storage compartment 2.

When the user rotates the first door 20 in the above-described state, the drive magnetic member 144 is moved toward the first door 20, as illustrated in FIG. 7(*b*). Movement of the drive magnetic member 144 may be achieved by external force from a motor or the like or elastic force of an elastic member such as a spring. The elastic force may be accumulated in the elastic member in a restrained state of the elastic member, and may be applied to the drive magnetic member 144 when the restrained state of the elastic member is released. That is, a configuration of any type may be employed to move the drive magnetic member 144, so long as the configuration can move the drive magnetic member 144 in a left direction toward the first door 20 when the first door 20 rotates.

Of course, an additional magnet may be provided at the first door 20, and another additional magnet may be provided at the drive magnetic member 144, in order to implement a design in which movement of the first door 20 influences on the drive magnetic member 144 in accordance with magnetic interference between the two magnets.

Meanwhile, when the first door 20 rotates to the state of FIG. 7(*b*) or 8(*b*), repulsion may be generated between the first surface 28*a* of the door dike magnetic member 28 and the first surface 102*a* of the first pillar magnetic member 102 as the first surface 28*a* approaches the first surface 102*a*. As a result, force causing the pillar 100 to be folded toward the second door 40 may be generated (cf. FIGS. 4 and 5).

In addition, attraction may be generated between the first surface 144*a* of the drive magnetic member 144 and the second surface 110*b* of the third pillar magnetic member 110 as the first surface 144*a* approaches the second surface 110*b*.

When the drive magnetic member 144 moves toward the second door 40 in the state of FIG. 7(*b*) or 8(*b*), force causing the pillar 100 to be folded toward the second door 40 may be additionally generated by virtue of the attraction between the drive magnetic member 144 and the third pillar magnetic member 110.

That is, the pillar 100 may be folded toward the second door 40 in accordance with magnetic relation of the drive magnetic member 144 and magnetic relation of the door dike member 28, as illustrated in FIG. 7(*c*) or 8(*c*).

Meanwhile, when the pillar 100 is sufficiently rotated, attraction may be generated between the second surface 46*b* of the second door magnetic member 46 and the first surface 106*a* of the second pillar magnetic member 106 and, as such, force to sufficiently fold the pillar 100 may be additionally provided.

Since folding of the pillar 100 is carried out under the condition that the first door 20 opens the storage compartment 2, and the second door 40 is maintained to seal the storage compartment 2, the pillar 100 does not obstruct a path, along which the drawer arranged at the side of the first door 20 moves, during withdrawal of the drawer. If the pillar 100 cannot be unfolded under the above-described condition, the width of the drawer arranged at the side of the first door 20 should be reduced by the unfolding width of the pillar 100. In this case, there is a problem in that the two drawers respectively arranged at opposite sides have different widths. In the illustrated embodiment, however, the drawer arranged at the side of the first door 20 may have a relatively great width because the pillar 100 is folded under the above-described condition. In addition, the drawers respectively arranged at opposite sides may have the same width.

On the other hand, the first door 20 may rotate to seal the storage compartment 2 under the condition that the second door 40 is maintained to seal the storage compartment 2, and the first door 40 has rotated to open the storage compartment 2.

These operations may be carried out in accordance with the order of FIGS. 7(*c*), 7(*b*) and 7(*a*) or FIGS. 8(*c*), 8(*b*) and 8(*a*).

The drive magnetic member 144 is moved toward the first door 20 when the first door 20 rotates from the state of FIG. 7(*c*) or 8(*c*) to the state of FIG. 7(*b*) or 8(*b*), in order to rotate the pillar 100 in the counterclockwise direction. That is, as the drive magnetic member 144 moves left, force causing unfolding of the pillar 100 is applied to the pillar 100.

In this case, magnetic interference may be generated between the door dike magnetic member 28 and the magnetic member installed at the pillar 100. In spite of such magnetic interference, the pillar 100 may be rotated in the counterclockwise direction by virtue of leftward movement of the drive magnetic member 144 because magnetic force between the drive magnetic member 144 and the third pillar magnetic member 110 has most influence on rotation of the pillar 100.

When the first door 20 and second door 40 seal the storage compartment 2, and the pillar 100 reaches a state of being unfolded toward the first door 20, as illustrated in FIG. 7(*a*) or 8(*a*), the drive magnetic member 144 cannot rotate the pillar 100 by movement thereof even when the drive magnetic member 144 moves right toward the second door 40. This is because a rotating arm portion of the pillar 100 extending from a rotation axis of the pillar 100 is short due to a linear movement path of the drive magnetic member 144 and, as such, sufficient rotational force to rotate the pillar 100 cannot be provided.

In the illustrated embodiment, the pillar 100 is folded when the first door 20 rotates to open or seal the storage compartment 2 under the condition that the second door 40 is maintained to seal the storage compartment 2. Accordingly, the basket 24 installed at the first door 20 does not interfere with the pillar 100 during rotation of the first door 20.

If the pillar 100 is maintained in an unfolded state, irrespective of rotation of the first door 20, the basket 24 installed at the first door 20 is caught on the pillar 100 during rotation of the first door 20. In order to avoid such a problem, the basket 24 should have smoothly curved corners, to be prevented from being caught on the pillar 100. In this case, the storage capacity of the basket 24 is reduced and, as such, the storage space usable by the user is substantially reduced.

In the illustrated embodiment of the present invention, when the basket 24 is rotated together with the first door 20, the pillar 100, which may obstruct a rotation trace of the basket 24, is folded. Accordingly, the storage space of the basket 24 installed at the first door 20 may be increased.

MODE FOR THE INVENTION

Various embodiments have been described in the best mode for carrying out the invention.

INDUSTRIAL APPLICABILITY

In accordance with the present invention, it may be possible to provide a refrigerator having two side-by-side type doors to open one storage compartment, thereby being capable of achieving an improvement in use convenience.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A refrigerator comprising:

a cabinet provided with a storage compartment;

an inner case that defines an appearance of the storage compartment;

a first door pivotally mounted to the cabinet, and that is configured to open or close one side of the storage compartment, wherein the first door is provided with a first door magnetic member with magnetic force, and a door dike magnetic member with magnetic force; and a second door pivotally mounted to the cabinet, and that is configured to open or close the other side of the storage compartment, wherein the second door is provided with a second door magnetic member with magnetic force and a pillar that is configured to rotate to come into contact with the first door, wherein the pillar is provided with a first pillar magnetic member that is configured to magnetically interfere with the first door magnetic member, and a second pillar magnetic member that is configured to magnetically interfere with the second door magnetic member, wherein the pillar is spaced apart from a top wall of the inner case and a bottom wall of the inner case, and is configured to remain spaced apart from the inner case when the second door is maintained to seal the storage compartment, and wherein the pillar is configured to rotate on the second door based on rotation angles of the first door and configured to rotate when the first door opens the storage compartment under a condition that the second door seals, by a magnetic force, the storage compartment, wherein gaskets are installed at rear sides of the first and second doors, and the first door does not contact any element that is installed in the storage compartment, and only the gasket of the first door contacts the inner case when the first door seals the storage compartment.

2. The refrigerator according to claim 1, wherein the pillar is configured to contact the first and second doors when the first and second doors are maintained to seal the storage compartment.

3. The refrigerator according to claim 1, wherein the pillar is configured to rotate when the first door rotates to open the storage compartment under a condition that the first and second doors have sealed the storage compartment.

4. The refrigerator according to claim 1, wherein:

the first door magnetic member is installed at a gasket of the first door;

the door dike magnetic member is installed at a door dike provided at a rear side of the first door; and the second door magnetic member is installed at a gasket of the second door.

5. The refrigerator according to claim 1, wherein a drive assembly is provided at the top wall of the inner case, and is configured to operate the pillar by magnetic force.

6. The refrigerator according to claim 5, wherein:

the drive assembly is provided with a drive magnetic member; and the pillar is provided with a third pillar magnetic member that is configured to magnetically interfere with the drive magnetic member.

7. The refrigerator according to claim 6, wherein the drive magnetic member is configured to move laterally with respect to a front side of the storage compartment.

8. The refrigerator according to claim 7, wherein the pillar is configured to rotate in a direction that the storage compartment is opened, when the drive magnetic member moves toward a hinge axis of the second door.

9. The refrigerator according to claim 5, wherein a portion of the top wall where the drive assembly is installed is flush with other portions of the top wall adjacent thereto.

10. The refrigerator according to claim 1, further comprising:

a first drawer arranged at a side of the first door; and a second drawer arranged at a side of the second door, wherein the first drawer and the second drawer have the same width.

11. The refrigerator according to claim 1, wherein:

the first drawer and the second drawer are arranged to be flush with each other; and the first drawer and the second drawer are independently withdrawable.

12. The refrigerator according to claim 1, wherein the first door and the second door have the same width.

13. A refrigerator comprising:

a cabinet provided with a storage compartment;

an inner case that defines an appearance of the storage compartment;

a first door pivotally mounted to the cabinet, and that is configured to open or close one side of the storage compartment; and a second door pivotally mounted to the cabinet, and that is configured to open or close the other side of the storage compartment, the second door is provided with a pillar rotatable to come into contact with the first door, wherein:

the first door is provided with a first door magnetic member having magnetic force, and a door dike magnetic member having magnetic force;

the second door is provided with a second door magnetic member having magnetic force; and the pillar is provided with a first pillar magnetic member to magnetically interfere with the first door magnetic member, and a second pillar magnetic member to magnetically interfere with the second door magnetic member.

14. The refrigerator according to claim 13, wherein the pillar is arranged to be rotatable when the first door opens the storage compartment under a condition that the second door seals the storage compartment.

15. The refrigerator according to claim 13, wherein the pillar contacts the first and second doors when the first and second doors are maintained to seal the storage compartment.

16. The refrigerator according to claim 13, wherein the pillar is rotated when the first door rotates to open the storage compartment under a condition that the first and second doors have sealed the storage compartment.

17. The refrigerator according to claim 13, wherein the first door and the second door have the same width.

* * * * *